US005655351A

United States Patent [19]

Pohl et al.

[11] Patent Number: 5,655,351

[45] Date of Patent: Aug. 12, 1997

[54] REINFORCED REFRIGERATOR DOOR ASSEMBLY AND METHOD OF ASSEMBLING THE SAME

[75] Inventors: Douglas A. Pohl, Rio; Charles O. Stanford, Galesburg; Robert D. Wagher, Knoxville, all of Ill.

[73] Assignee: Maytag Corporation, Newton, Iowa

[21] Appl. No.: 636,382

[22] Filed: Apr. 23, 1996

[51] Int. Cl.[6] ..... A47B 13/08

[52] U.S. Cl. ..... 52/784.15; 52/290.1; 52/742.11; 428/75

[58] Field of Search ..... 52/784.13, 784.15, 52/786.13, 792.1, 796.12, 797.1, 799.11, 799.12, 790.1, 668, 657, 291, 309.16, 742.11; 428/178.75

[56] References Cited

U.S. PATENT DOCUMENTS

| | | |
|---|---|---|
| 92,205 | 7/1869 | Mullet et al. . |
| 1,230,567 | 6/1917 | Comee . |
| 1,328,918 | 1/1920 | Fulda . |
| 1,645,692 | 10/1927 | De Penning . |
| 2,310,860 | 2/1943 | Moon . |
| 2,311,045 | 2/1943 | Goulooze . |
| 2,413,597 | 12/1946 | Armstrong . |
| 2,612,661 | 10/1952 | Semple . |
| 2,630,605 | 3/1953 | Hobson et al. . |
| 2,652,601 | 9/1953 | Slopa et al. . |
| 2,665,456 | 1/1954 | Morton . |
| 2,696,644 | 12/1954 | Graw . |
| 2,708,294 | 5/1955 | Saunders . |
| 2,718,446 | 9/1955 | Hinkel . |
| 2,764,785 | 10/1956 | Sulcek . |
| 4,536,990 | 8/1985 | Siegrist et al. . |
| 4,585,129 | 4/1986 | Lundqvist . |
| 4,747,245 | 5/1988 | Lesmeister et al. . |
| 4,779,939 | 10/1988 | Stich . |
| 4,787,133 | 11/1988 | Lesmeister et al. . |
| 4,878,700 | 11/1989 | Brune . |

FOREIGN PATENT DOCUMENTS

| | | |
|---|---|---|
| 149221 | 11/1952 | Australia . |
| 473128 | of 1952 | Italy . |

*Primary Examiner*—Creighton Smith

*Attorney, Agent, or Firm*—Everett G. Diederiks, Jr.

[57] ABSTRACT

A pair of cross brace members are diagonally positioned within an internal cavity of a refrigerator door shell that is defined by an outer front panel, side walls and in-turned, return flanges. The cross brace members are generally L-shaped in cross-section and are interengaged at central portions thereof which are specifically configured with respective cut-out connection portions to aid in assembly and positioning of the cross brace members. The cross brace members have tabs at terminal ends thereof which extend above planes defined by generally horizontally extending upper sections of the cross brace members. These tabs are adapted to rest upon respective ones of the return flanges to initially mount the cross brace members within the door shell. Once the cross brace members are appropriately positioned within the door shell, insulation foam is supplied into the internal cavity. The foam flows through longitudinally spaced holes provided in generally upright sections of the cross brace members and around the cross brace members. Once the insulation foam hardens, the cross brace members become fixed to the door shell such that a reinforced refrigerator door assembly is defined. An inner door finer can then be attached to the return flanges.

18 Claims, 3 Drawing Sheets

REINFORCED REFRIGERATOR DOOR ASSEMBLY AND METHOD OF ASSEMBLING THE SAME

BACKGROUND OF THE INVENTION

1. Field of the Invention

The present invention pertains to the art of refrigerators and, more particularly, to a refrigerator door that is reinforced by a cross-brace assembly.

2. Discussion of the Prior Art

As is widely known, a refrigerator includes a cabinet portion and a door, both of which are generally made from sheet metal for economical reasons. The door is pivotally mounted to the cabinet through a hinge arrangement in order to provide access to the food storage space of the refrigerator. In addition, a seal is attached about an inner periphery of the door to create a seal with the cabinet when the door is closed.

In order to provide enhanced storage space within refrigerators, it has become common practice to form a refrigerator door with a liner that defines various shelves or other storage areas upon which additional food items can be supported. The increased weight of the door due to these food items can result in an undesirable mount of twisting of the door. Such twisting occurs on the handle side of the door, i.e., on an opposite side to the hinge arrangement. If the mount of twisting becomes too great, the seal will break away from the cabinet and an air leak will occur.

To minimize or prevent such twisting from occurring, it has heretofore been proposed to reinforce the door with one or more braces. If the door is molded of plastic, a brace arrangement in the form of ribs provided on the back of a front panel portion of the door can be readily provided (see, for example, U.S. Pat. No. 2,708,294). However, for mainly economical reasons, substantially all refrigerator doors on the market are formed from sheet metal that is bent to define return flanges to which is attached the door liner. It has also been proposed to secure braces to these return flanges in order to address the above-described twisting problem. U.S. Pat. Nos. 2,612,661 and 4,747,245 disclose exemplary bracing arrangements of this type wherein a pair of diagonally arranged and intersecting cross braces are secured directly to return flanges or brackets attached to the return flanges. Generally after the cross braces are secured and the liner is attached, the door is insulated by injecting foam therein as clearly disclosed in these patents.

Securing cross braces in this manner adds undesirable costs to the manufacture of the refrigerator and can also be quite time consuming. As discussed in each of the '661 and '245 patents, holes formed in the cross braces must be aligned with holes formed directly in the return flanges or a bracket secured thereto and then mechanical fasteners are used to interconnect the braces to the door. Obviously, considerable time is required to align these components and then to manually secure the fasteners which unduly adds cost to the overall manufacturing process. Of course, since these components are made from metal, they could also be welded together but this would also represent cost increases.

Therefore, there exists a need in the art to provide an improved reinforced refrigerator door assembly which avoids the twisting problems discussed above but which also is easy to assemble and cost effective.

SUMMARY OF THE INVENTION

In accordance with the present invention, a reinforced refrigerator door assembly is provided which incorporates a cross-brace assembly including two brace members that are interengaged with each other at central portions thereof. The brace members are adapted to be placed within an internal cavity defined between the return flanges and a front panel portion of the door and supported therein by terminal end tabs of the brace members resting upon the return flanges. Actually, each terminal end of the brace members includes an upwardly sloping portion and a flat portion. The flat portion rests on a respective return flange and, due to the presence of the sloping portions, the remainder of each brace member is entirely positioned within the internal cavity while being spaced from the front panel portion of the door.

In the preferred embodiment, the brace members are generally L-shaped in cross-section so as to define upright planar sections and horizontal planar sections. The central portion of each of the brace members is particularly configured to aid in assembly. More specifically, a lower one of the brace members is formed with a generally V-shaped cut-out in its horizontal planar section which leads to a slot in its upright planar section while an upper one of the brace members is only formed with a slotted connection in its upright planar section. This slotted connection preferably includes a sloping cut-out section that leads to a slot. With this construction, the central portion of the upper brace member can be readily interconnected with the central portion of the lower brace member with the sloping cut-out section aiding in aligning the slots. Furthermore, the inclusion of the V-shaped cut-out in the lower brace member enables the two brace members to be angularly rotated relative to each other through a predetermined range to aid in easily positioning the tabs upon respective portions of the return flanges.

During assembly, the brace members are positioned within the door with the tabs resting on the return flanges and with only thin, longitudinally extending lower edges of the upright planar sections being arranged adjacent the front panel portion. Foam insulation is then either poured or injected into the internal cavity. The upright planar sections of the brace members are formed with a plurality of longitudinally spaced holes through which the insulation can flow. With only the thin edges of the upright planar portions being adjacent the front panel portion of the door, only a minimal amount of surface area is provided between the brace members and the front panel portion to assure that the insulating foam does not accumulate in this region which would result in bulging of the front panel portion outward. Once the insulation hardens, the brace members will be securely held in place. Therefore, the cross-brace assembly is foamed in situ and the door is rigidified such that any twisting is substantially prevented and the possibility of the door seal undesirably pulling away from the cabinet is eliminated.

Additional features and advantages of the invention will become more readily apparent from the following detailed description of a preferred embodiment thereof when taken in conjunction with the drawings wherein like reference numerals refer to corresponding parts in the several views.

DETAILED DESCRIPTION OF THE PREFERRED EMBODIMENT

Figure 1:
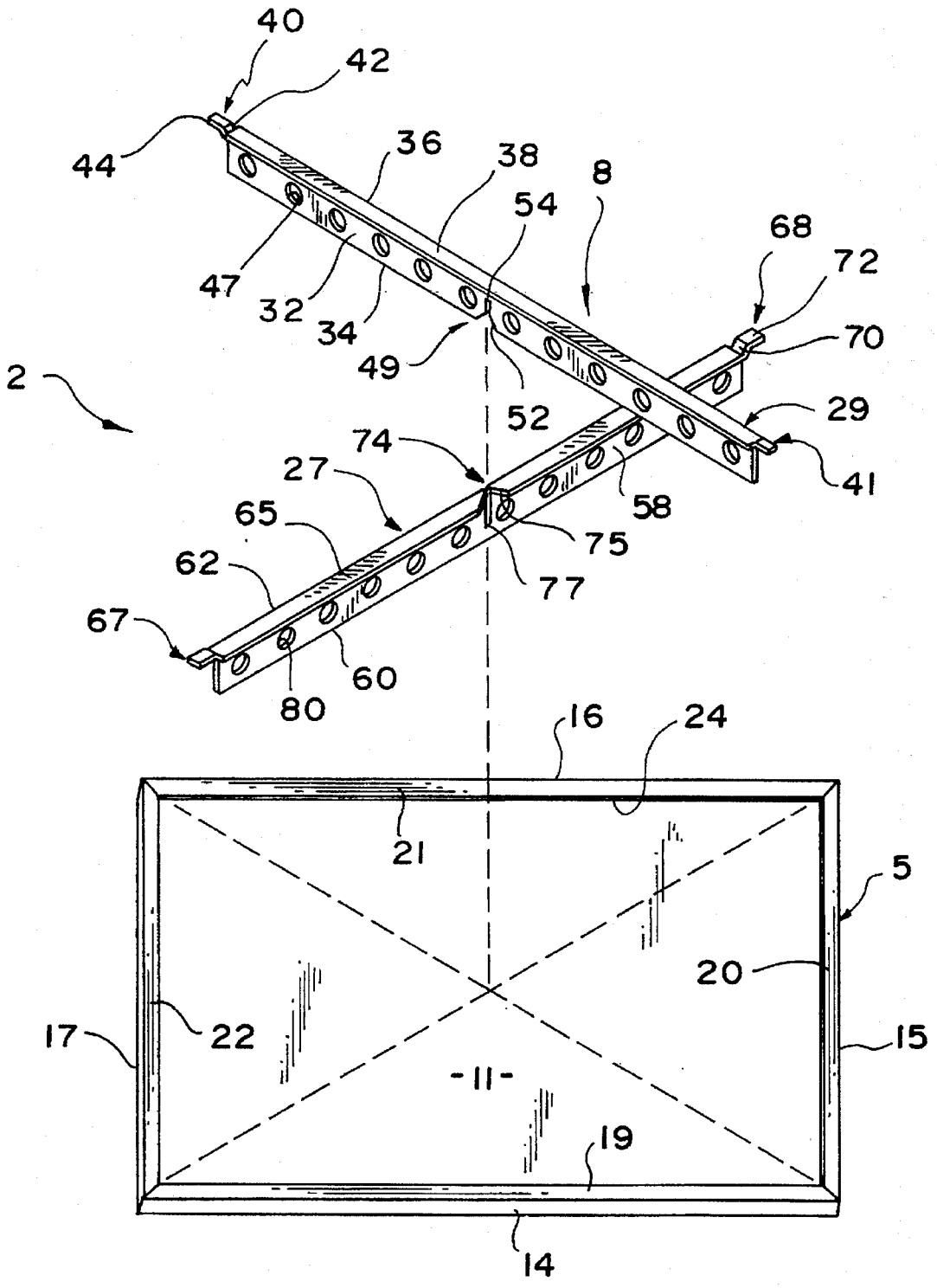
FIG. 1 is an exploded view of the reinforced refrigerator door assembly of the invention.

With initial reference to FIG. 1, the reinforced refrigerator door assembly of the invention is generally indicated at 2 and comprises a door shell 5 and a reinforcing cross-brace assembly 8. Door shell 5 includes an outer front panel 11 having an inner surface (not labeled), side walls 14–17 and in-turned return flanges 19–22. In the embodiment disclosed, door shell 5 is formed from sheet metal which is bent once to form side walls 14–17 and again to form return flanges 19–22. With this arrangement, return flanges 19–22 are arranged substantially parallel to outer front panel 11 and an internal cavity 24 is defined within the door shell 5.

Figure 2:
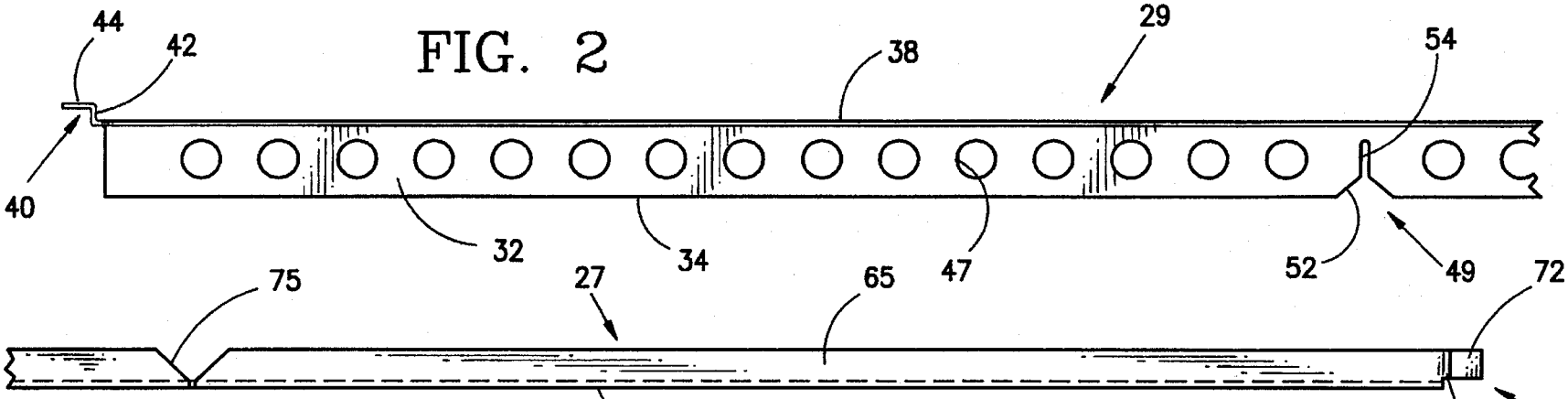
FIG. 2 is a side view of a portion of one of the brace members incorporated in the reinforced refrigerator door assembly.
Figure 3:
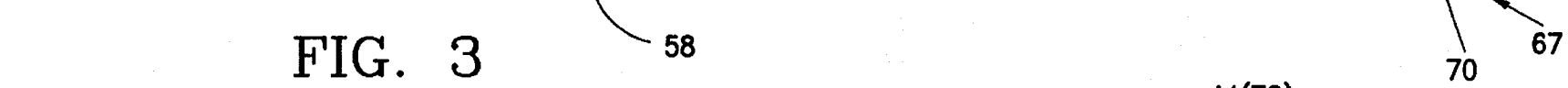
FIG. 3 is a top view of a portion of another brace member incorporated in the reinforced refrigerator door assembly.
Figure 5:
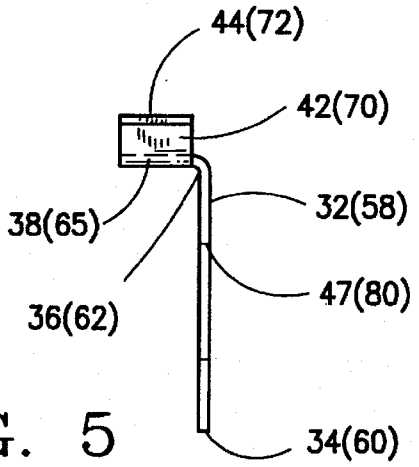
FIG. 5 is an end view of either of the brace members in accordance with the invention.
Figure 4:
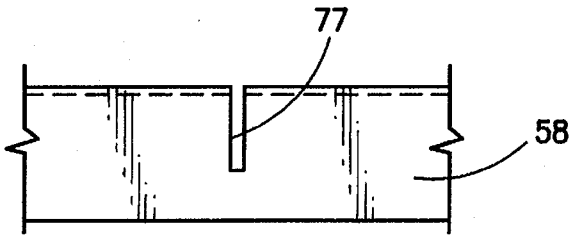
FIG. 4 is a side view of a central portion of the brace member of FIG. 3.

Reinforcing cross-brace assembly 8 comprises a first, lower cross brace member 27 and a second, upper cross brace member 29. As shown in FIGS. 1, 2 and 5, upper cross-brace member 29, which is generally L-shaped in cross-section, includes a first planar section 32 that has a lower edge 34 and a bent upper edge 36 that leads to a second planar section 38. For reference purposes, first planar section 32 is shown to be upright and second planar section 38 is arranged generally horizontally. Extending longitudinally from terminal ends of second planar section 38 are tabs 40 and 41. Each tab 40, 41 includes an upwardly sloping portion 42 and a generally flat portion 44. With this arrangement, each flat portion 44 extends within a plane that is located above the plane defined by second planar section 38 as best shown in FIGS. 2 and 5.

As dearly shown in FIGS. 1 and 2, first planar section 32 is provided with a plurality of longitudinally spaced through holes 47 and a central portion thereof is formed with a connection cut-out generally indicated at 49. Connection cut-out 49 includes a sloping section 52 stemming from lower edge 34 and a slotted section 54 that extends approximately two-thirds the way through first planar section 32 towards second planar section 38.

With particular reference to FIGS. 1, 3, 4 and 5 and in a manner similar to that described above with reference to the structure of upper cross brace member 29, lower cross brace member 27 includes a first planar section 58 having a lower edge 60 and a bent upper edge 62 that leads to a second planar section 65. Projecting longitudinally from the terminal ends of second planar section 65 is a pair of tabs 67 and 68. Each tab 67, 68 includes an upwardly sloping portion 70 and a flat portion 72 such that flat portion 72 of each tab 67, 68 extends in a plane that is above a plane defined by second planar section 65.

Lower cross brace member 27 is provided with a centrally located connection cut-out as illustrated at 74 which includes a generally V-shaped cut-out section 75 formed in second planar section 65 and a slotted section 77 that extends from cut-out section 75 into first planar section 58. As best shown in FIG. 5, slotted section 77 extends approximately two-thirds the way through first planar section 58. In addition, first planar section 58 is provided with a plurality of longitudinally spaced through holes 80.

Figure 6:
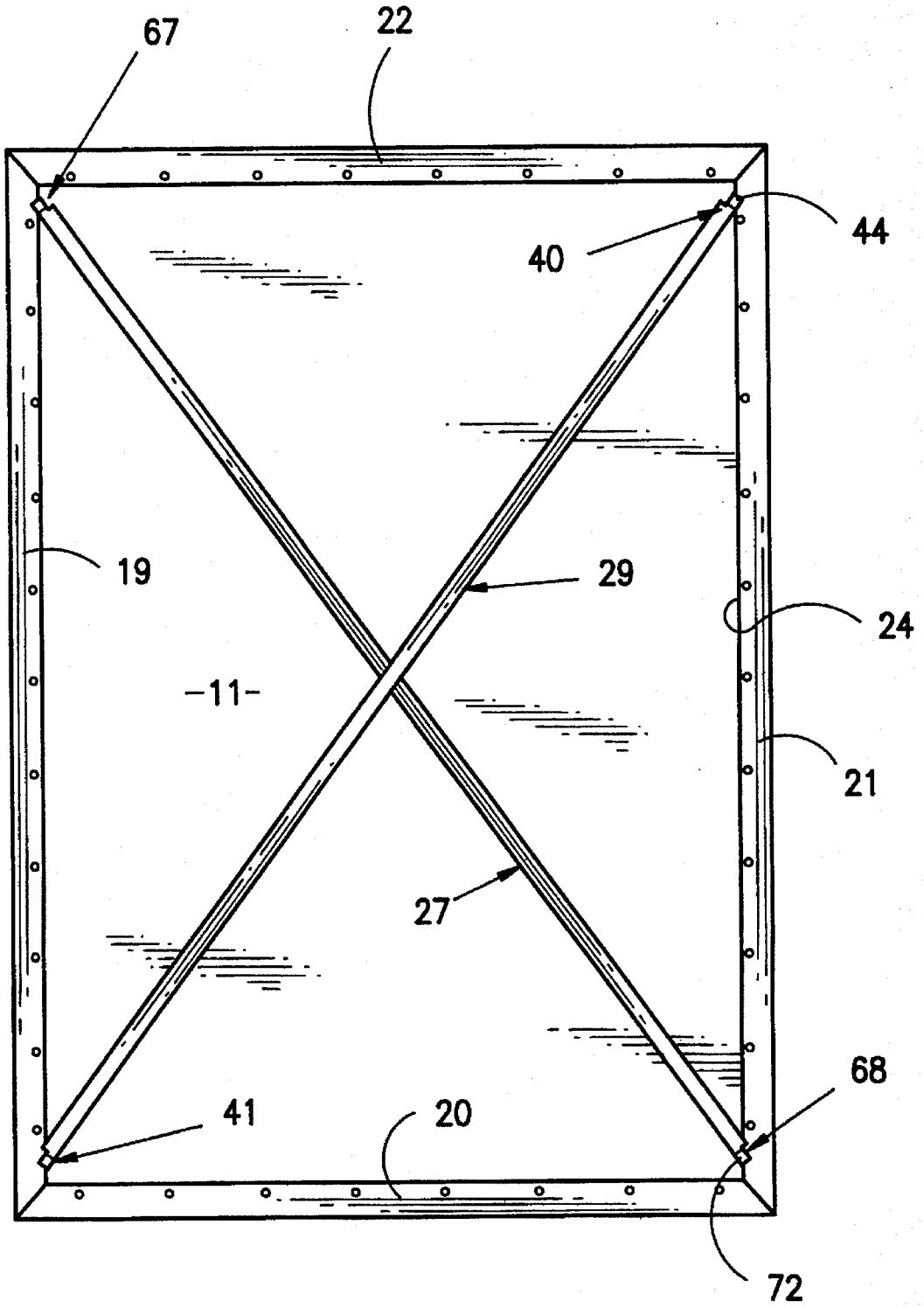
FIG. 6 is a top view of the reinforced refrigerator door assembly following assembly.

Reference will now be made to FIGS. 1 and 6 in describing the manner in which reinforcing cross-brace assembly 8 is positioned and secured within internal cavity 24 of door shell 5 in order to form structurally reinforced refrigerator door assembly 2. With door shell 5 placed on a flat surface with internal cavity 24 opening upwards, lower cross brace member 27 is positioned generally diagonally within internal cavity 24 with flat portions 72 of tabs 67 and 68 resting upon respective return flanges 19 and 21. In this position, lower edge 60 is spaced above the inner surface of outer front panel 11 while second planar section 65 is located slightly below a plane defined by return flanges 19–22 and connection cut-out 74 faces upwardly.

Upper cross brace member 29 is then placed within internal cavity 24 with connection cut-out 49 interengaging with connection cut-out 74 until flat portions 44 of tabs 40 and 41 rest upon return flanges 19 and 21. As with lower cross brace member 27, second planar section 38 of upper cross brace member 29 is arranged above the plane defined by return flanges 19–22. The interengaging of upper cross brace member 29 with lower cross brace member 27 is made easy as upper cross brace member 29 is automatically guided into an appropriate position as first planar section 58 rides along sloping cut-out section 52 and then into slotted section 54. In addition, due to the presence of generally V-shaped cut-out section 75, upper cross brace member 29 can be appropriately angled relative to lower cross brace member 27. Of course, although both upper and lower cross brace members 27 and 29 are shown and disclosed to be positioned atop return flanges 19 and 21, alternative return flanges, such as return flanges 20 and 22, could provide the supporting function depending on the angle between the upper and lower cross brace members 27 and 29.

From the above description, it should be readily apparent that upper and lower cross brace members 27 and 29 only rest upon respective ones of the return flanges 19–22 such that, along with the arrangement of connection cut-outs 49 and 74, minimal time and effort is required to perform this operation. Once reinforcing cross brace assembly 8 is appropriately positioned in internal cavity 24, foam insulation is either poured or injected into internal cavity 24. In either case, the foam insulation is caused to flow through holes 47 and 80 and to fill internal cavity 24 such that lower and upper cross brace members 27 and 29 are interconnected with door shell 5 through in situ foaming. Once the foam hardens, cross-brace assembly 8 is fixedly secured within door shell 5.

Therefore, cross brace assembly 8 is initially only attached to door shell 5 through tabs 40, 41, 67 and 68 resting on respective return flanges 19–22 but, once foamed in situ, structurally reinforces door shell 5 in order to prevent twisting thereof. After cross-brace assembly 8 is fixed, an inner door liner can be attached to return flanges 19–22 in a manner known in the art in order to provide the additional food item storage space desired. Since second planar sections 38 and 65 are located below the plane defined by the return flanges 19–22 due to the presence of sloping portions 42 and 70 of tabs 40, 41, 67 and 68, cross brace members 27 and 29 will not unduly interfere with the connection of the liner. In addition, since only thin edges 34 and 60 are positioned adjacent the inner surface portion of outer front panel 11, the insulation foam will not accumulate between edges 34 and 60 and outer front panel 11 such that potential bulging of outer front panel 11 at these locations is avoided.

Based on the above, it should be readily apparent that the refrigerator door assembly 2 of the present invention is less time consuming and costly to manufacture than prior proposed systems and, due to the fact that the insulation foam hardens to form a solid core, cross brace assembly 8 is equally rigidly secured with door shell 5 in order to perform a reinforcing function commensurate with the known prior art arrangements.

Although described with respect to a preferred embodiment of the invention, it should be readily understood that various changes and/or modifications may be made without departing from the spirit of the invention. In general, the invention is only intended to be limited by the scope of the following claims.

We claim:

1. A refrigerator door assembly comprising:

a generally rectangular shell including an outer front panel having an inner surface located in a first plane and peripheral portions, side walls extending at an angle to said first plane from respective said peripheral portions of said outer front panel and at least opposing in-turned flanges that extend inwardly from predetermined ones of said side walls wherein an internal cavity is defined within said shell by said outer front panel, said side walls and said in-turned flanges;

a reinforcing cross brace assembly including first and second cross brace members that intersect generally intermediate their lengths, each of said cross brace members including a first section defining a second plane and a second section, said first section having opposing longitudinally extending first and second edges, said second section extending from the second edge of said first section in a third plane that is generally perpendicular to said second plane, each of the second sections of said cross brace members including first and second end portions that define longitudinally extending tabs, said cross brace assembly being positioned within said shell with said tabs resting on respective ones of said in-turned flanges and said first edge of each of said cross brace members being spaced from said inner surface; and insulation arranged in the internal cavity of said shell and around said cross brace members interconnecting said cross brace assembly and said shell.

2. The refrigerator door assembly according to claim 1, wherein said insulation comprises a sole interconnection between said cross brace assembly and said shell member.

3. The refrigerator door assembly according to claim 1, wherein each of said tabs is cantilevered from a respective said second section of said cross brace members.

4. The refrigerator door assembly according to claim 3, wherein each of said tabs includes a first portion that slopes upwardly from a respective said second section and a flat portion resting on a respective said in-turned flange.

5. The refrigerator door assembly according to claim 3, wherein said third plane is arranged parallel to said first plane.

6. The refrigerator door assembly according to claim 5, wherein the first section of each of said cross brace members is located closer to the inner surface of said outer front panel than the second section of each of said cross brace members.

7. The refrigerator door assembly according to claim 5, further comprising a plurality of longitudinally spaced holes extending through the first section of each of said cross brace members.

8. The refrigerator door assembly according to claim 1, wherein, intermediate their lengths, each of said cross brace members are provided with connection portions interengaging said cross brace members, the connection portion of said first cross brace member including a cut-out section provided in the second section thereof which opens into a slotted section formed in the first section thereof and the connection portion of the said second cross brace member including a slotted section formed in the first section thereof.

9. The refrigerator door assembly according to claim 8, wherein the connection portion of said second cross brace member further includes a sloping cut-out section leading from the first edge thereof to said slotted section.

10. The refrigerator door assembly according to claim 8, wherein each of said tabs is cantilevered from a respective said second section of said cross brace members.

11. The refrigerator door assembly according to claim 10, further comprising a plurality of longitudinally spaced holes extending through the first section of each of said cross brace members.

12. The refrigerator door assembly according to claim 1, wherein said shell and said reinforcing cross brace assembly are formed of metal.

13. A method of assembling a reinforced refrigerator door assembly comprising:

providing a door shell including an outer from panel having an inner surface located in a first plane, side walls extending at an angle to said first plane from respective peripheral portions of said outer front panel and at least opposing inturned flanges that extend inwardly from predetermined ones of said side walls such that an internal cavity as defined within said shell by said outer front panel, said side walls and said in-turned flanges;

providing a reinforcing cross-brace assembly including first and second cross brace members each including a first section defining a second plane and a second section extending in a third plane that is generally perpendicular to said second plane;

forming cantilevered tabs at respective longitudinal ends of the second section of each of said first and second cross brace members;

diagonally positioning said first and second cross brace members within said shell with said tabs resting on respective ones of said in-turned flange portions said first and second cross brace members intersecting each other and a lower edge of each of said first and second cross brace members being spaced from said inner surface;

substantially filling said internal cavity with foamed insulation; and allowing said foamed insulation to harden, thereby strutrurally interconnecting said cross brace assembly and said shell.

14. The method of assembling a reinforced refrigerator door assembly according to claim 13, further comprising: forming each of said tabs with a first portion that slopes upwardly from a respective said second section and a flat portion that, at least initially rest on a respective said in-turned flange such that the second section of each of said cross brace members is located below said in-turned flanges when positioned within said shell.

15. The method of assembling a reinforced refrigerator door assembly according to claim 13, further comprising: providing a plurality of longitudinally spaced through holes in the first section of each of said cross brace members and permitting said foamed insulation to flow through said through holes during filling of said internal cavity.

16. The method of assembling a reinforced refrigerator door assembly according to claim 13, further comprising: forming each of said cross brace members, intermediate their lengths, with connection portions interengaging said cross brace members.

17. The method of assembling a reinforced refrigerator door assembly according to claim 16, further comprising: forming the connection portion of said first cross brace member by providing a cut-out section in the second section thereof which opens into a slotted section formed in the first section thereof and forming the connection portion of said second cross brace member by providing a slotted section in the first section thereof.

18. The method of assembling a reinforced refrigerator door assembly according to claim 17, further comprising: forming the connection portion of said second cross brace member with a sloping cut-out section that leads from the lower edge of said second cross brace member to the slotted section thereof.

* * * * *